US006981916B2

(12) United States Patent
Coulton

(10) Patent No.: US 6,981,916 B2
(45) Date of Patent: Jan. 3, 2006

(54) ROOF RIDGE VENT

(75) Inventor: Michael S. Coulton, Lansdale, PA (US)

(73) Assignee: Benjamin Obdyke, Inc., Horsham, PA (US)

( * ) Notice: Subject to any disclaimer, the term of this patent is extended or adjusted under 35 U.S.C. 154(b) by 180 days.

(21) Appl. No.: 10/684,024

(22) Filed: Oct. 10, 2003

(65) Prior Publication Data

US 2005/0090197 A1 Apr. 28, 2005

(51) Int. Cl.
*F24F 7/02* (2006.01)

(52) U.S. Cl. ..... 454/365; 52/57; 52/96; 52/198; 52/199

(58) Field of Classification Search ..... 454/365; 52/57, 95, 96, 198, 199, 302.1
See application file for complete search history.

(56) References Cited

U.S. PATENT DOCUMENTS

| | | | | |
|---|---|---|---|---|
| 2,200,031 A | | 5/1940 | Lee | |
| 2,214,183 A | | 9/1940 | Seymour | |
| 2,704,500 A | | 3/1955 | Bonforte | |
| 4,280,399 A | * | 7/1981 | Cunning | 454/365 |
| 4,325,290 A | | 4/1982 | Wolfert | |
| 4,876,950 A | | 10/1989 | Rudeen | |
| 4,942,699 A | | 7/1990 | Spinelli | 52/57 |
| 5,149,301 A | | 9/1992 | Gates | 454/365 |
| 5,167,579 A | | 12/1992 | Rotter | 454/365 |
| 5,425,672 A | | 6/1995 | Rotter | 454/365 |
| 5,561,952 A | * | 10/1996 | Damron | 52/198 |
| 5,673,521 A | | 10/1997 | Coulton et al. | 52/199 |
| 5,704,834 A | | 1/1998 | Sells | 454/365 |
| 5,803,805 A | | 9/1998 | Sells | 454/364 |
| 5,826,383 A | | 10/1998 | Garrison | 52/198 |
| 5,902,432 A | | 5/1999 | Coulton et al. | 156/199 |
| 5,921,863 A | | 7/1999 | Sells | 454/359 |
| 5,960,595 A | | 10/1999 | McCorsley, III et al. | 52/199 |
| 6,079,166 A | | 6/2000 | Mason et al. | 52/198 |
| 6,213,868 B1 | | 4/2001 | Sells | 454/359 |
| 6,298,613 B1 | | 10/2001 | Coulton et al. | 52/199 |
| 6,308,472 B1 | | 10/2001 | Coulton et al. | 52/198 |
| 6,450,882 B1 | | 9/2002 | Morris et al. | 454/365 |

* cited by examiner

*Primary Examiner*—Harold Joyce
(74) *Attorney, Agent, or Firm*—Howson and Howson

(57) ABSTRACT

A ridge vent, roof ridge vent installation, and method of installing a ridge vent is provided. Preferably, the ridge vent includes a ventilation material that has opposite longitudinally-extending side edges that are covered with an air permeable filter material. A longitudinally-extending central section of the vent is not covered by the air permeable filter material, is transparent, and enables a ventilating air flow to pass through the vent in a manner requiring only a single pass through the air permeable material. This permits greater air flow through the vent, and the transparent central section simplifies and enables accurate placement of the vent on the roof ridge.

23 Claims, 2 Drawing Sheets

ROOF RIDGE VENT

FIELD OF THE INVENTION

The present invention relates to a roof ridge vent that enhances air circulation between a roof of a building and an underlying ceiling structure, and more particularly, the present invention relates to a vent, a roof ridge vent installation, and a method of installing a vent on a roof ridge.

BACKGROUND OF THE INVENTION

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over a slot present along the ridge of a roof. These types of vents are known as ridge vents.

Examples of ridge vents are provided by U.S. Pat. No. 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli. These patents are owned, or co-owned, by Benjamin Obdyke, Inc., the assignee of the present application.

The above referenced McCorsley and Coulton '613 patents disclose roof ridge vents comprising a continuous, indeterminate-length, roll-form, openwork web, or mat, of randomly convoluted polymeric filaments. The mat is capable of being rolled lengthwise in a spiral roll after or during manufacture and unrolled lengthwise during installation on a roof ridge. A plurality of cusps, or hollow spacer elements, project from the upper face of the mat so that, when the apex portions of the cusps confront the roof surface, the upper face of the mat is spaced from the roof surface thereby creating a path for air flow between the shingles overlying the upper face of the vent and the underlying roof. A continuous air permeable fabric backing is thermally bonded to the cusps of the mat to prevent weather and insect infiltration into the attic space.

While the roof ridge vents disclosed in the above referenced patents function in a superior manner, there continues to be a need for further improvements with respect to roof ridge vents and their installation. To this end, an increased amount of ventilating air flow through the ridge vent is desired without compromising weather infiltration resistance. In addition, a ridge vent that can be accurately aligned over a roof ridge in a simplified and efficient manner is desired. Further, the vent should be capable of being manufactured economically and formed into a roll for shipping, transportation and subsequent installation.

OBJECTS OF THE INVENTION

With the foregoing in mind, a primary object of the present invention is to provide an efficient and economical roof ridge vent that is capable of being readily and properly installed in a manner requiring labor skills possessed by the average roof installer.

Another object of the present invention is to provide a roof ridge vent which provides an increased amount of air venting capacity.

SUMMARY OF THE INVENTION

More specifically, the present invention provides a roof ridge vent including air permeable filter material attached to a continuous, elongate strip of ventilation material. The air permeable filter material prevents weather infiltration into the ventilation material, and the ventilation material has a longitudinally-extending central section extending between a pair of longitudinally-extending outer sections, has upper and lower faces that extend across the central and outer sections, has a plurality of ventilation passageways therein, and has a pair of longitudinally-extending outer peripheral side edges that provide paths of ventilation therethrough. The air permeable filter material extends on the side edges and the upper and lower faces of the outer sections of the ventilation material but does not extend over at least a portion of the upper and lower faces of the central section of the ventilation material.

Preferably, the ventilation material is an openwork mat of randomly convoluted polymeric filaments having a plurality of cusps projecting from one of the upper and lower faces of the ventilation material. Other ventilation materials can also be utilized according to the present invention. In addition, preferably a plurality of see-through openings, or windows, are provided in the central section of the ventilation material so that the central section is substantially transparent and so that, during installation of the vent on an underlying roof ridge, the underlying roof ridge and slot are clearly visible to an installer of the vent through the transparent central section of the vent. Thus, proper alignment can be continuously verified in a simply manner during and after installation of the vent on a roof ridge.

According to another aspect of the present invention, a roof ridge vent installation is provided including the above referenced vent in combination with cap shingles and a roof having a ridge with an elongate open slot.

According to a further aspect of the present invention, a method of installing a roof ridge vent is provided. An elongate strip of openwork material is placed over an open slot formed along a roof ridge. The openwork material provides a plurality of ventilation passageways therein and has a pair of longitudinally-extending outer peripheral side edges that provide paths of ventilation therethrough. During installation, the open slot and roof ridge is viewed through a substantially transparent longitudinally-extending central portion of the openwork material to ensure proper alignment of the openwork material on the roof ridge. Thereafter, the openwork material is secured to the roof ridge with nails or like fasteners.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 2:
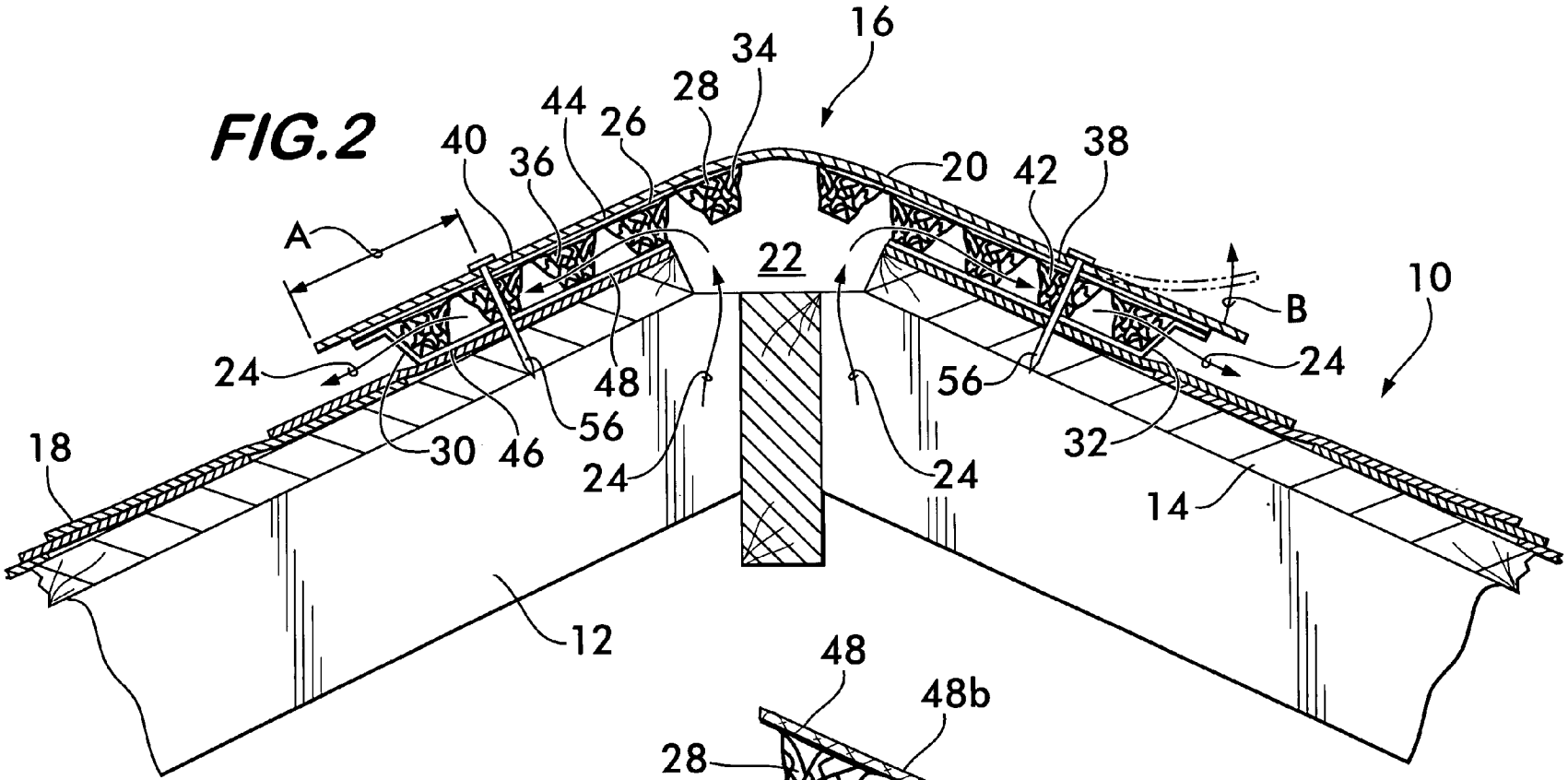
FIG. 2 is an elevational cross-sectional view of a roof ridge vent installed on a roof ridge according to the present invention.

Referring now to the drawings, FIG. 2 illustrates a roof 10 having a typical construction which utilizes a ridge vent. The roof 10 is constructed from a plurality of rafters 12 supported at their lower ends by front and rear walls (not shown) of the building. A roof deck 14 is typically constructed of plywood, or other suitable panels, to provide an outer sheathing of the building. The roof deck 14 is secured to the rafters 12, extends to the end walls, and forms a ridge, or peak, 16 therebetween. Shingles 18 are secured to the roof deck 14 to finish sloping portions of the roof 10 in accordance with conventional construction practices. Cap shingles 20 are installed overlying the ridge vent to cover the ridge 16 of the roof 10. An open slot 22 (see FIG. 2) is provided along the length of the roof ridge 16 to provide a passageway for air to vent from the underlying attic area to the ambient atmosphere as illustrated by arrows 24.

The roof ridge vent 26 according to the present invention is made of a continuous, elongate strip of a ventilation material 28 that provides a plurality of ventilation passageways enabling air to vent from the open slot 22 formed in the roof 10 to and through a pair of longitudinally-extending outer peripheral side edges, 30 and 32, of the vent 26. The specific type of openwork material used as the ventilation material 28 in the vent 26 can be of various forms. For example, a preferred material is an indeterminate-length mat 34 of randomly convoluted polymeric filaments formed with a plurality of cusps, or hollow spacer elements, 36 as disclosed in U.S. Pat. Nos. 5,960,595 and 6,298,613, the disclosures of which are incorporated herein by reference. The layout, or pattern, of the cusps 36 is designed to resist compression of the vent 26 during and after installation and to afford ready rolling and unrolling of the vent 26 during manufacture and installation. Alternative ventilation materials (not shown) include fibrous mats without cusps, thermoplastic webs with hollow spacer elements, and materials having defined passageways formed therein such as corrugated materials. Preferably, the ventilation material 28 is such that it can be rolled lengthwise into a spiral roll during manufacture and stored, transported and supplied to installers in roll-form.

The ventilation material 28 has a longitudinally-extending central section 38 between a pair of longitudinally-extending outer sections, 40 and 42. In the illustrated embodiment, the cusps, or hollow spacer elements, 36 are disposed in a plurality of longitudinal rows extending the length of the ventilation material 28, and the outer sections, 40 and 42, are defined as including the outermost three rows of cusps 36. See FIG. 1. The ventilation material 28 also has an upper face 44 and a lower face 46 that extend across the central and outer sections, 38, 40 and 42. During installation, the ventilation material 28 is provided with an inverted V-shaped transverse cross-section in which the outer sections, 40 and 42, are disposed at a dihedral angle relative to one another as best illustrated in FIG. 2 to conform to the surface of the roof ridge 16.

Preferably, at least a portion of the surface of the ventilation material 28 is attached to and covered by air permeable filter material 48 that permits air to flow outwardly in the manner illustrated by the arrows 24 in FIG. 2 and that prevents rain, snow, blowing foreign objects, insects and the like from entering into the vent 26 through and/or adjacent the side edges, 30 and 32, of the vent 26 in a direction opposite to that shown by arrows 24. The air permeable filter material 48 can be, for instance, a sheet-like fabric of non-woven nylon polyester, a needle-punched non-woven material, a metal mesh screen, or any like material that provides air permeability through small spaces in their structure. Preferably, the air permeable filter material 48 is thermally or adhesively bonded to the ventilation material 28 and extends across the side edges, 40 and 42, and selected regions of the upper and lower faces of the ventilation material 28.

Figure 2A:
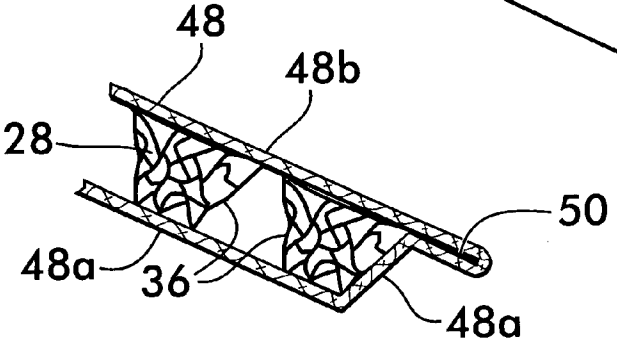
FIG. 2A is a cross-sectional view of a side edge of an alternate roof ridge vent according to the present invention.

In the illustrated embodiments, the side edges 30 and 32 of the vent 26 is formed by an outermost row of cusps 36 covered by a layer of air permeable filter material 48*a*. Preferably, an edge flange 50 extends outwardly from side edges 30 and 32 along the upper face 44 of the ventilation material 28. The air permeable filter material 48*a* is bonded to the underside of the edge flange 50 and along the lower face 46 of the ventilation material to ensure that air permeable filter material 48*a* spans completely across each side edge, 30 and 32. A separate piece of air permeable filter material 48*b* extends on the upper face 44 of the ventilation material 28. Alternatively, as illustrated in FIG. 2A, the air permeable filter material 48*a* and 48*b* can be a single strip of material that is folded around the edge flange 50.

Figure 1:
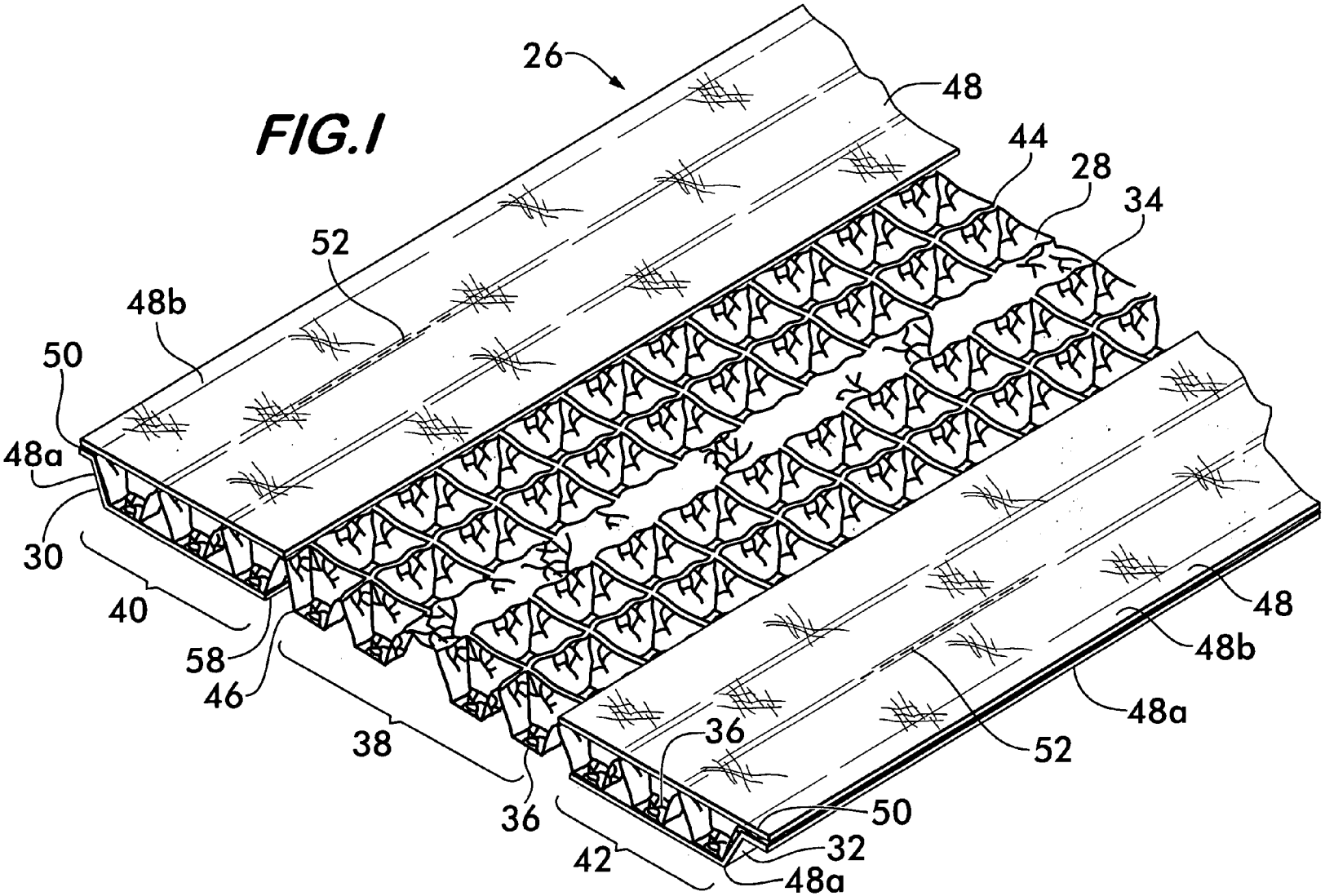
FIG. 1 is a perspective view of an unrolled roof ridge vent embodying the present invention.

As best illustrated in FIG. 1, nail lines 52 and 54 are identified on the upper face of the vent 26 for aiding proper placement of nails 56 by the installer. The nail lines 52 and 54 extend a spaced distance "A" from the side edges, 30 and 32. During windy conditions, it is possible for a section 20*a* of the cap shingle 20 extending outwardly from nail 56 to deflect upward in a direction "B". For example, see FIG. 2. Thus, to ensure the formation of a proper weather infiltration barrier, the air permeable filter material 48*b* on the upper face 44 of the ventilation material 28 extends continuously from the edge flange 50 to beyond the adjacent nail line, 52 or 54. For example, the nail lines 52, 54 may be adjacent the second outermost rows of cusps 36 and the air permeable filter material 48*b* may extend over the outer three or four outermost rows of cusps 36 as illustrated in FIGS. 1 and 2.

Air permeable filter material 48*a* extends on the lower face 46 of the ventilation material to an extent at least beyond intended nail lines, 52 and 54 so that the material extends inward of the nails 56 as installed as shown in FIG. 2. This should ensure the prevention of weather infiltration adjacent the lower face 46 of the vent 26. Preferably, the inward edge 58 of air permeable filter material 48*a* terminates at a location such that it does not extend over the open slot 22 formed in the roof ridge 16. See FIG. 2. Thus, the ventilating air illustrated by arrow 24 only makes a single pass through the filter material 48 when passing through the ridge vent 26. This permits an increase in the amount of air flow through the open slot 22 and vent 26 and into the ambient atmosphere. In addition, since the inward edge 58 of the air permeable filter material 48*a* terminates short of the open slot 22, the air permeable filter material 48*a* is prevented from wicking moisture to the open slot 22.

As discussed above, the air permeable filter material, 48*a* and 48*b*, does not extend completely across the upper and lower faces 44 and 46 of the ventilation material; rather, the upper and lower faces 44 and 46 of the central section 38 of the ventilation material 28 remain exposed and uncovered. This provides the central section 38 with a transparent, or "see-through", property and enables easier installation with more accurate alignment of the ridge vent 26 on the roof ridge 16. To this end, the preferred embodiment has a ventilation material made of a thin layer of randomly convoluted polymeric filaments formed with hollow cusps 36. Numerous openings are present between filaments thereby providing a central section 38 that is substantially transparent. To this end, the central section 38 is transparent to the same extent that a window screen is transparent. Thus, the central section can be seen through so that, as the vent 26 is being installed on the roof ridge 16, the roof ridge 16 and open slot 22 is clearly visible to the installer through the central section 38. Adjustments to the positioning of the vent 26 on the roof ridge 16 can be made prior to installing each nail 56.

A vent 26 with a see-through central section 38 is not limited to vents made of convoluted filaments. Rather, various alternatives providing a see-through central section of a vent can be utilized. For example, if the ventilation material 28 is solid, it can be provided with openings to provide a see-through window or it can be made, at least partially, with a transparent material, such as, a transparent plastic material, a mesh screen, or the like. In addition, non-rollable sectional ridge vents can also be provided with see-through central sections.

By way of example, and not by way of limitation, the ridge vent 26 can be made of an elongate openwork mat of randomly convoluted polymeric filaments such that the vent has a width of about 10.5 inches and a thickness of about ⅝ of an inch. The filaments can be molded to form eight uniform and longitudinally-extending rows of cusps 36, and a nail line 52 and 54 can be identified adjacent each side edge, 30 and 32, between each pair of outermost rows of cusps. An air permeable filter fabric 48*b* can extend continuously on the upper face 44 of the vent 26 from each edge flange 50 over the first two outermost rows of cusps 36. An air permeable filter fabric 48*a* can extend continuously from an underside of each edge flange 50 across the adjacent side edge, 30 or 32, and on the lower face 46 of the vent 26 over the first three outermost rows of cusps 36. Thus, at least the central two rows of cusps are exposed and uncovered and provide a transparent viewing window to objects on the other side of the vent 26.

A method of installing a ridge vent 26 according to the present invention includes placing an elongate strip of openwork, or ventilation, material 28 over an open slot 22 formed along a roof ridge 16. Preferably, the openwork material 28 is provided in a spiral roll, is unrolled lengthwise on the roof ridge 16, and has a longitudinally-extending central section that is transparent. Thus, the method according to the present invention includes viewing and visually inspecting alignment of the vent 26 with the roof ridge 16. Adjustments to the placement of the vent can be made before sinking each nail through the vent and into the roof deck. In this manner, precise centering of the vent 26 on the roof ridge 16 can be readily accomplished with a minimum of skill and effort.

Preferably, the openwork material is partially covered with an air permeable filter material, or fabric, 48 as discussed above. Thus, the method of installing and aligning the vent 26 includes the step of ensuring that the air permeable filter material 48 does not overlie the open slot 22. The method also includes securing cap shingles over the vent 26 along a pair of nail lines, 52 and 54, such that the air permeable material 48*b* extending on the upper face 44 of the vent 26 extends continuously from each side edge, 30 and 32, to beyond each adjacent nail line, 52 and 54, respectively.

The above-described roof ridge vent, roof ridge vent installation and method of installing a roof ridge vent according to the present invention provides a roll-form vent which is easy to install, inexpensive to manufacture, and provides increased air flow therethrough.

While a preferred roof ridge vent, roof ridge vent installation and method of installing a roof ridge vent have been described in detail, various modifications, alterations, and changes may be made without departing from the spirit and scope of the vent according to the present invention as defined in the appended claims.

What is claimed is:

1. A roof ridge vent, comprising:

a continuous, elongate strip of ventilation material providing a plurality of ventilation passageways therein and having a pair of longitudinally-extending outer peripheral side edges that provide paths of ventilation therethrough; and air permeable filter material attached to said ventilation material;

said ventilation material having a longitudinally-extending central section extending between a pair of longitudinally-extending outer sections and having upper and lower faces that extend across said central and outer sections;

said filter material extending on said side edges and said upper and lower faces of said outer sections of said ventilation material; and at least a portion of said upper and lower faces of said central section of said ventilation material remaining exposed and uncovered by said filter material.

2. A roof ridge vent according to claim 1, wherein said elongate strip of ventilation material is an openwork mat of randomly convoluted polymeric filaments.

3. A roof ridge vent according to claim 1, wherein said ventilation material has a plurality of hollow, openwork spacer elements projecting from one of said upper and lower faces of said ventilation material to space said upper face of said ventilation material from said lower face.

4. A roof ridge vent according to claim 1, wherein said central section of said ventilation material is transparent.

5. A roof ridge vent according to claim 1, wherein said elongate strip of ventilation material is selected from a group consisting of a fibrous mat, a thermoplastic web having hollow spacer elements, and a corrugated material.

6. A roof ridge vent, comprising:

a continuous strip of openwork material providing a plurality of ventilation passageways therein and having a pair of longitudinally-extending outer peripheral side edges that provide paths of ventilation therethrough; and air permeable filter material attached to said openwork material;

said openwork material having a longitudinally-extending central section extending between a pair of longitudinally-extending outer sections and having upper and lower faces that extend across said central and outer sections;

said filter material extending on said side edges and said upper and lower faces of said outer sections of said openwork material;

at least a portion of said upper and lower faces of said central section of said openwork material remaining exposed and uncovered by said filter material; and said central section of said openwork material having a plurality of openings so that said central section is substantially transparent;

whereby, during installation of said vent on an underlying roof ridge having an open slot, the underlying roof ridge and slot are clearly visible to an installer of said vent through said central section of said vent.

7. A roof ridge vent according to claim 6, wherein said openwork material is a mat of randomly convoluted polymeric filaments.

8. A roof ridge vent according to claim 7, wherein said mat of randomly convoluted polymeric filaments is formed with a plurality of cusps.

9. A roof ridge vent installation comprising a roof having a ridge with an elongate open slot, a ridge vent secured to said roof overlying said ridge and open slot, and cap shingles secured to said roof and overlying said ridge vent, said vent being a length of ventilation material providing ventilation passageways therein and having a pair of longitudinally-extending side edges that provide paths of ventilation therethrough, said ventilation material having a longitudinally-extending central section extending between a pair of longitudinally-extending outer sections, said central section being substantially transparent, whereby, during installation of said vent on said roof ridge, said underlying roof ridge and slot are visible through said central section of said ridge vent.

10. A roof ridge vent installation according to claim 9, wherein said ridge vent is a continuous, elongate strip of openwork material having upper and lower faces that extend across said central and outer sections, wherein air permeable filter material is secured to said openwork material and extends over said side edges and said upper and lower faces of said outer sections of said openwork material, and wherein at least a portion of said upper and lower faces of said central section of said openwork material remains exposed and uncovered by said filter material and is transparent.

11. A roof ridge vent installation according to claim 10, wherein said openwork material is a mat of randomly convoluted polymeric filaments having a plurality of openings.

12. A roof ridge vent installation according to claim 11, wherein said mat of randomly convoluted polymeric filaments is formed with a plurality of cusps that space said upper face from said lower face.

13. A roof ridge vent installation according to claim 12, wherein said lower face of said openwork material faces said roof, and wherein said air permeable filter material extending on said lower face does not extend across said open slot in said ridge of said roof.

14. A roof ridge vent installation according to claim 13, wherein said air permeable filter material extending on said lower face does not overlie said open slot.

15. A roof ridge vent installation according to claim 12, wherein said upper face of said openwork material faces said cap shingles, wherein said cap shingles are secured to each outer section of said vent along a longitudinally extending nail line, and wherein said air permeable filter material on each of said outer sections of said vent extends continuously on said upper face from said side edge to beyond said nail line.

16. A roof ridge vent installation according to claim 9, wherein said length of ventilation material is selected from a group consisting of a fibrous mat, a thermoplastic web having hollow spacer elements, and a corrugated material.

17. A method of installing a roof ridge vent, comprising the steps of:

placing an elongate strip of openwork material over an open slot formed along a roof ridge, said openwork material providing a plurality of ventilation passageways therein and having a pair of longitudinally-extending outer peripheral side edges that provide paths of ventilation therethrough;

viewing the open slot and roof ridge through a longitudinally-extending central portion of said openwork material to ensure proper alignment of said openwork material on the roof ridge;

securing said openwork material to said roof ridge after said viewing step.

18. A method according to claim 17, wherein said central portion of said openwork material has a plurality of openings through which said underlying roof ridge and open slot are visible during said viewing step.

19. A method according to claim 18, wherein said openwork material has air permeable filter material extending over said side edges and on upper and lower faces of said openwork material, and wherein said central portion of said upper and lower faces of said openwork material are exposed and uncovered by said filter material so that said underlying roof ridge and open slot are visible through said central portion during said viewing step.

20. A method according to claim 19, wherein said openwork material is positioned on said roof ridge such that said air permeable filter material does not overlie the open slot.

21. A method according to claim 20, further comprising the step of securing cap shingles on said openwork material along a pair of nail lines such that said air permeable material extending on said upper face of said openwork material extends continuously from each side edge to beyond an adjacent one of said nail lines.

22. A method according to claim 17, wherein said openwork material is provided in a spiral roll and is unrolled lengthwise on the roof ridge during said placing step.

23. A method according to claim 17, wherein said elongate strip of openwork material is selected from a group consisting of a mat of randomly convoluted polymeric filaments having cusps, a fibrous mat, a thermoplastic web having hollow spacer elements, and a corrugated material.

* * * * *